US008556028B1

(12) United States Patent
Nason et al.

(10) Patent No.: US 8,556,028 B1
(45) Date of Patent: Oct. 15, 2013

(54) ACOUSTIC MODULE FOR ENCLOSURE PANEL

(75) Inventors: Brian S. Nason, Phillipston, MA (US); Laurence A. Kenny, III, Rindge, NH (US)

(73) Assignee: Braden Manufacturing, LLC, Tulsa, OK (US)

( * ) Notice: Subject to any disclaimer, the term of this patent is extended or adjusted under 35 U.S.C. 154(b) by 0 days.

(21) Appl. No.: 13/439,417

(22) Filed: Apr. 4, 2012

(51) Int. Cl.
*E04B 1/82* (2006.01)

(52) U.S. Cl.
USPC ..... 181/290; 181/284

(58) Field of Classification Search
USPC ..... 181/290, 284
See application file for complete search history.

(56) References Cited

U.S. PATENT DOCUMENTS 2,927,665 A * 3/1960 Hauf ..... 52/262
4,120,376 A * 10/1978 Palmer ..... 181/204
4,143,495 A * 3/1979 Hintz ..... 52/145
5,123,874 A * 6/1992 White, III ..... 454/251
5,268,540 A * 12/1993 Rex ..... 181/210
5,907,932 A * 6/1999 LeConte et al. ..... 52/144
7,578,468 B2 * 8/2009 Drost ..... 244/117 R
2009/0194365 A1 * 8/2009 Johnson ..... 181/290

OTHER PUBLICATIONS

Prior offer for sale of replacement doors, Jan. 6, 2011 (not admitted as prior art; see accompanying letter and appendices A and B).

* cited by examiner

*Primary Examiner* — Forrest M Phillips
(74) *Attorney, Agent, or Firm* — Senniger Powers LLP

(57) ABSTRACT

An acoustic panel for an enclosure includes a panel plate having opposite interior and exterior sides, and an acoustic module assembly including a plurality of acoustic modules secured on the interior side of the panel plate. Each acoustic module includes a retainer having a retainer base, spaced in generally opposing relationship with the panel plate, and upper and lower retainer walls extending outward from the retainer base toward the panel plate to define a horizontal channel-shaped cavity. An acoustic insulation member is received in the horizontal channel-shaped cavity of the retainer, such that the acoustic insulation member is positioned between the interior side of the panel plate and the retainer base.

20 Claims, 10 Drawing Sheets

ACOUSTIC MODULE FOR ENCLOSURE PANEL

FIELD OF THE DISCLOSURE

The present invention generally relates to an acoustic module for an enclosure panel.

BACKGROUND OF THE DISCLOSURE

Gas turbine generators as well as mechanical drive units are often surrounded by an enclosure. The enclosure insures that noise levels in the environment are reduced. The enclosure is subjected to high temperatures, environmental exposure and other externally applied loadings. The materials of the enclosure are, therefore, subjected to thermal exposure related stresses.

After a period of service, the performance of an enclosure may degrade and experience acoustic issues, perforation issues and/or corrosion issues. Existing gas turbine acoustical enclosure doors and panels are of a welded construction. The welded components present difficulties associated with replacing or repairing panels or doors. Currently, it is difficult to provide a replacement door with penetrations such as detectors and windows that match the original door. The difficulties require timely site surveys or require that most replacements of components be fabricated on-site, which increases costs.

SUMMARY

In one aspect, an acoustic panel for an enclosure generally comprises a panel plate having opposite interior and exterior sides, and an acoustic module assembly including a plurality of acoustic modules secured on the interior side of the panel plate. Each acoustic module includes a retainer having a retainer base, spaced in generally opposing relationship with the panel plate, and upper and lower retainer walls extending outward from the retainer base toward the panel plate to define a horizontal channel-shaped cavity; and an acoustic insulation member received in the horizontal channel-shaped cavity of the retainer, such that the acoustic insulation member is positioned between the interior side of the panel plate and the retainer base.

In another aspect, an acoustic module for a panel of an enclosure generally comprises a retainer having a perforated retainer base, upper and lower retainer walls extending outward from the retainer base toward the panel plate to define a horizontal channel-shaped cavity, and upper and lower lips extending toward one another from respective upper and lower retainer walls to define respective upper and lower tracks extending along the horizontal channel-shaped cavity. An acoustic insulation member is received in the horizontal channel-shaped cavity of the retainer. The acoustic insulation member has upper and lower edge margins received in respective upper and lower tracks of the retainer to facilitate retention of the acoustic insulation member in the horizontal channel-shaped cavity.

In yet another aspect, a method of making an acoustic panel for an enclosure generally comprises stacking a plurality of acoustic modules on an interior side of a panel plate, where each acoustic module includes a retainer having a retainer base and upper and lower retainer walls extending outward from the retainer base to define a horizontal channel-shaped cavity, and an acoustic insulation member received in the horizontal channel-shaped cavity of the retainer. A module frame is attached to the interior side of the panel plate to secure the stacked plurality of acoustic modules on the interior side of the panel plate.

BRIEF DESCRIPTION OF THE DRAWINGS

Corresponding reference characters indicate corresponding parts throughout the drawings.

DETAILED DESCRIPTION OF THE DRAWINGS

Figure 1:
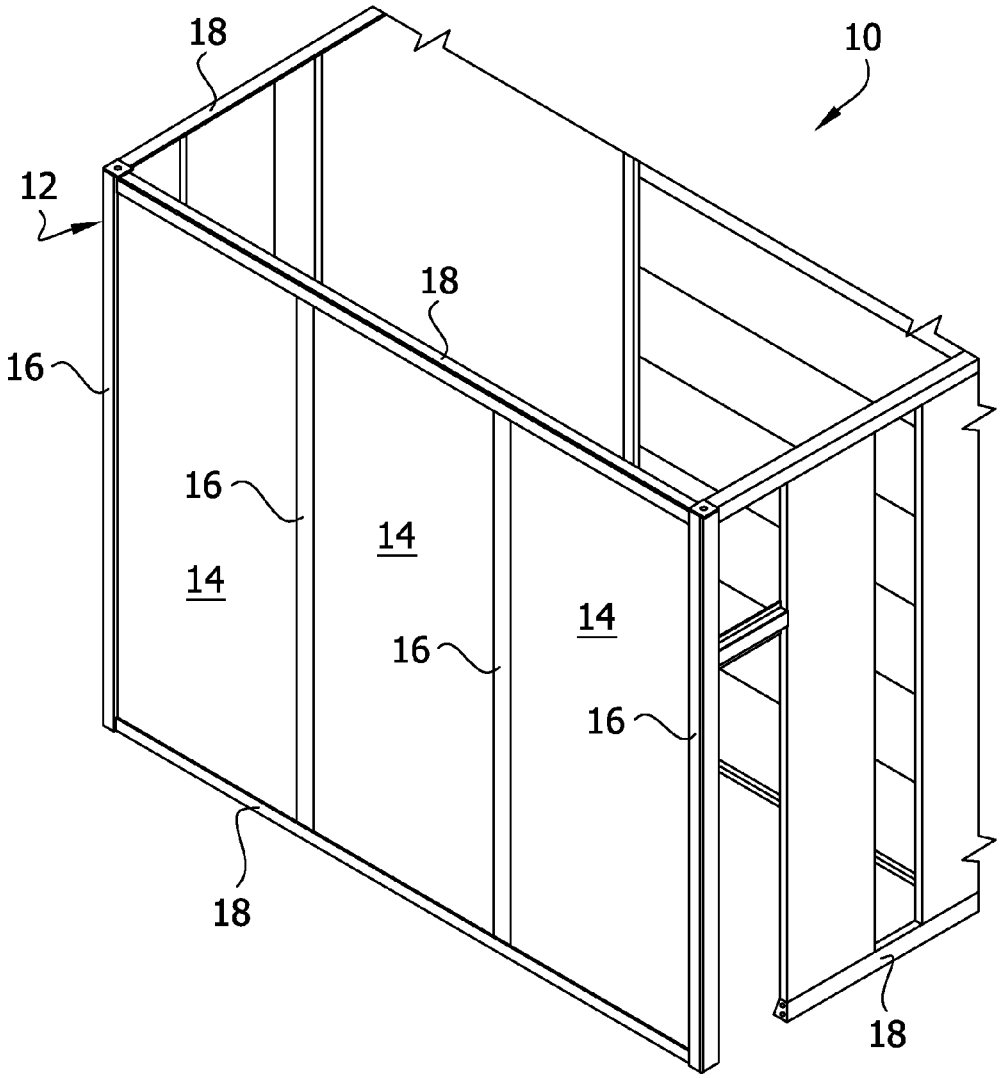
FIG. 1 is a perspective of an enclosure, such as for a gas turbine.
Figure 2:
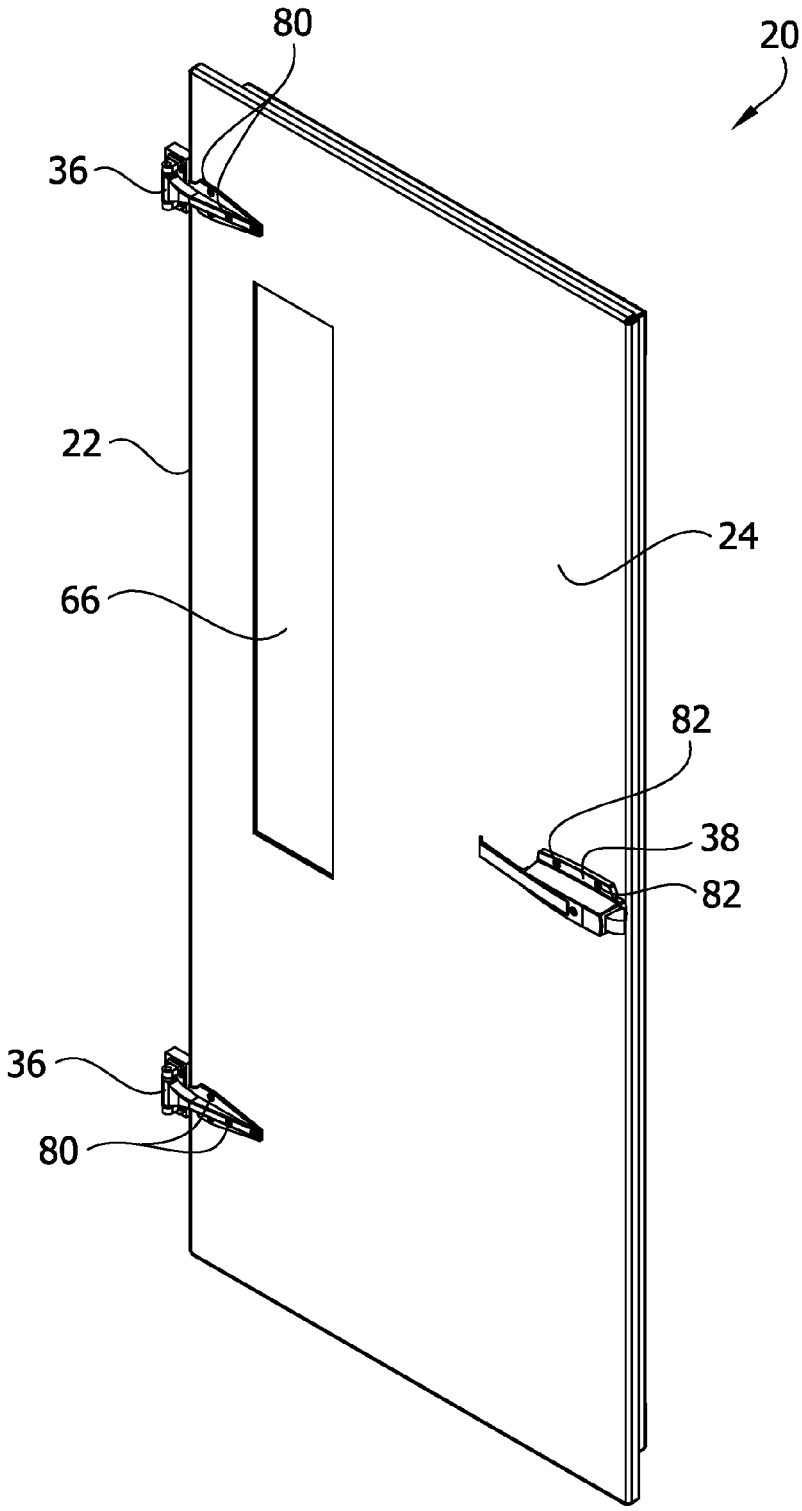
FIG. 2 is a perspective of a door panel for the enclosure in FIG. 1.

Referring to the drawings, an enclosure, such as for a gas turbine engine, is generally indicated at 10. The enclosure 10 includes an enclosure frame generally indicated 12, and a plurality of acoustic panels 14 secured to the frame. The frame 12 may be a conventional metal frame, including metal studs 16 secured to upper and lower joists 18. Typically, acoustic panels 14 will include a plurality of wall panels (FIG. 9), and one or more door panels (FIGS. 2-8) that are secured to the frame with hinges or other components. In FIG. 1, the acoustic panels 14 are indicated generically and are not indicated as being either a door panel or a wall panel.

Referring to FIGS. 2-8, an embodiment of a door panel for the enclosure 10 is generally indicated at 20. The door panel 20 includes a door plate 22 (broadly, a panel plate) having an exterior side 24 (FIG. 2) and interior side 26 (FIG. 4), a plurality of stacked acoustic modules, each generally indicated at 30, on the interior side of the door plate, and a module frame, generally indicated at 32, securing the acoustic modules as an acoustic assembly on the door plate. In use, the exterior side 24 of the door plate 22 is disposed outside the enclosure 10, and the interior side 26 faces the interior of the enclosure when the door panel 20 is closed. The door plate 22 may be constructed from metal, such as galvanized steel or other material. A plurality of threaded studs 34 (or other fasteners) for securing the module frame 32 to the door plate 22, as described below, are welded (or otherwise attached) to the interior side 26 of the door plate. The door plate 22 hingedly attaches to the enclosure 10 using upper and lower hinges 36 on the exterior side 24 of the door plate. The door panel 20 also includes an exterior handle 38 on the exterior side 24 of the door plate 22, and a release handle 40 on the acoustic module assembly. Attaching these door components 36, 38, 40, and other possible door components, to the door panel 20 is described in more detail below. As explained below, an embodiment of a wall panel for the enclosure 10 (FIG. 9) is substantially similar to the door panel 20, with the exception that the wall panel does not include the door components 36, 38, 40. Accordingly, the teachings set forth below with respect to the door panel 10 apply equally to a wall panel for the enclosure 10.

Referring to FIGS. 4-7, each acoustic module 30 includes an acoustic insulation member 44, and an acoustic retainer, generally indicated at 46, retaining the acoustic insulation member in a selected location relative to the door plate 22. The acoustic retainer 46 comprises a generally planar, perforated retainer base 50, and upper and lower retainer walls 52, 54, respectively, extending outward from the base to define a horizontal channel-shaped cavity 55 into which the acoustic insulation member 44 is inserted (e.g., packed). In the illustrated embodiment (FIGS. 6 and 7), upper and lower retainer lips (i.e., return flanges) 56, 58, respectively, extend toward one other from respective upper and lower retainer walls 52, 54 to define upper and lower retainer tracks 60, 62, respectively, extending along the horizontal channel-shaped cavity 55. Upper and lower edge margins of the acoustic insulation member 44 are received in the respective upper and lower retainer tracks 60, 62 to facilitate retention of the acoustic insulation member in the retainer channel-shaped cavity 55. (The upper and lower retainer tracks 60, 62 serve an additional function, as explained in detail below.) When the acoustic module 30 is secured to the door plate 22, as described below, the retainer base 50 is spaced in generally opposing relationship with the door plate, and the upper and lower retainer walls 52, 54, respectively, extend toward the door plate, so that the acoustic insulation member 44 is disposed between the interior side 26 of the door plate and the retainer base. In the illustrated embodiment, the opposite ends of the retainer channel-shaped cavity 55 are open (FIG. 6), although it is understood that the channel-shaped cavity ends may be closed or partially closed to further facilitate retention of the acoustic insulation member 44 in the channel-shaped cavity.

Figure 4:
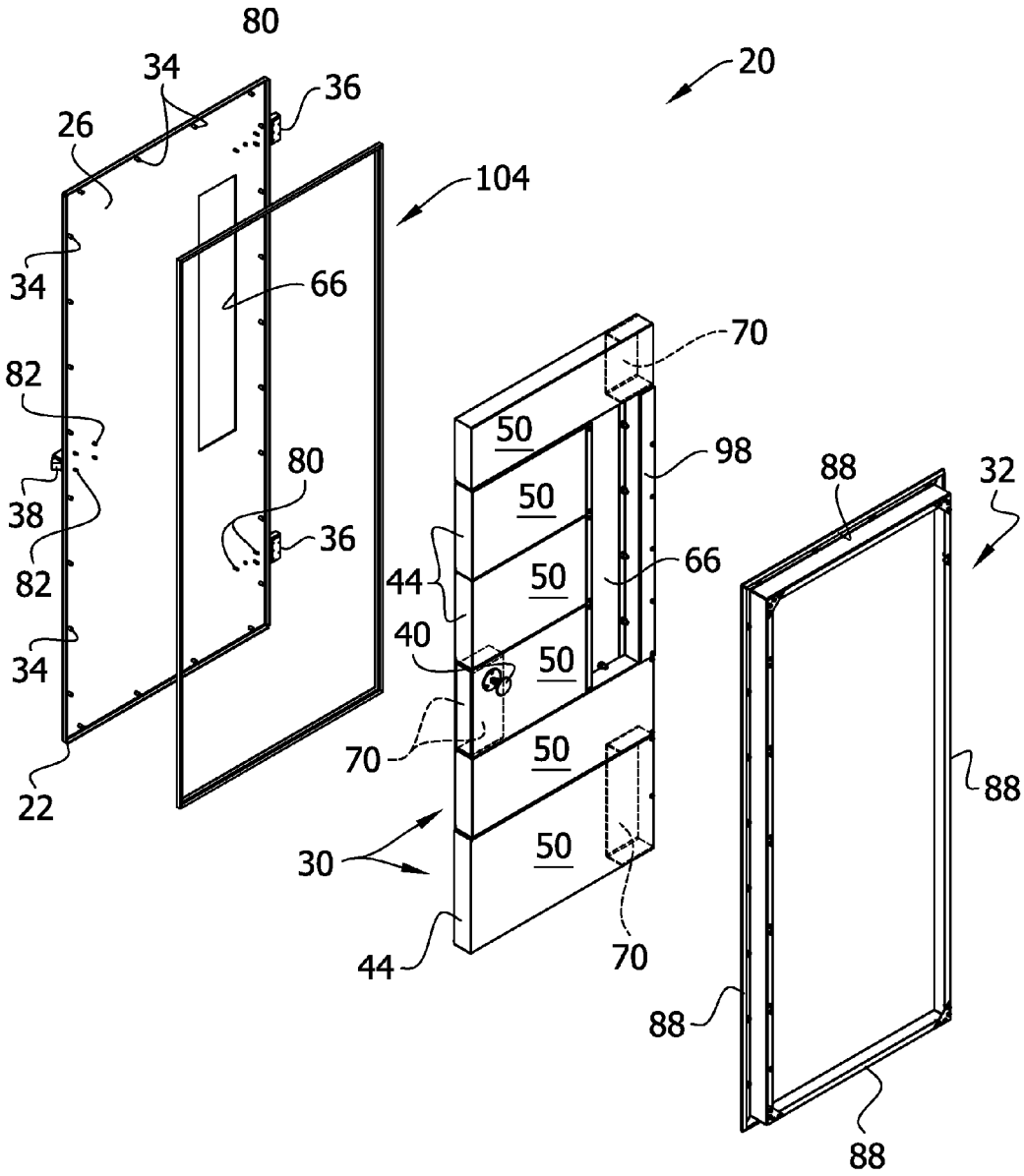
FIG. 4 is an exploded view of the door panel.
Figure 5:
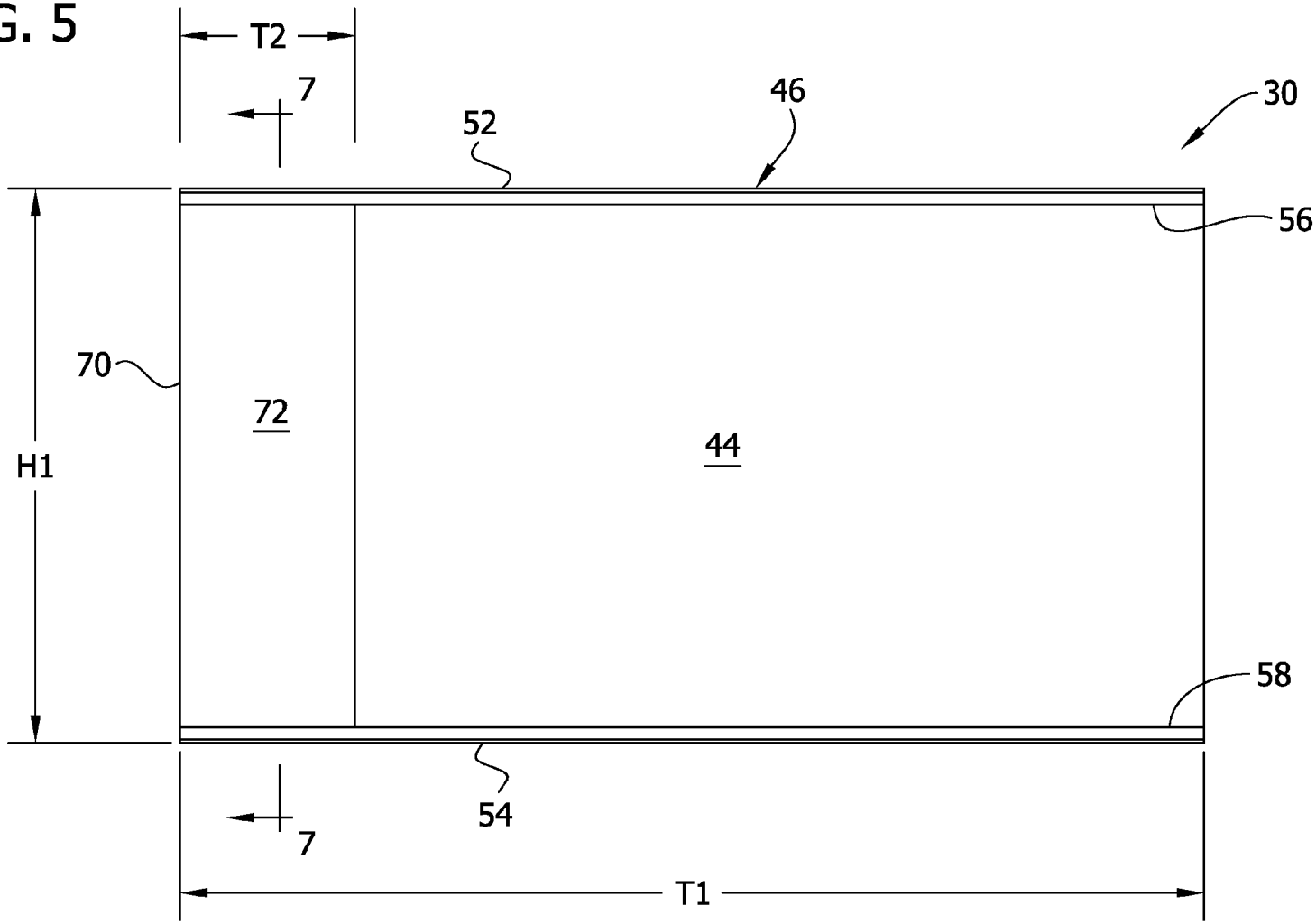
FIG. 5 is a rear elevational view of one of a plurality of acoustic modules of the door panel.
Figure 6:
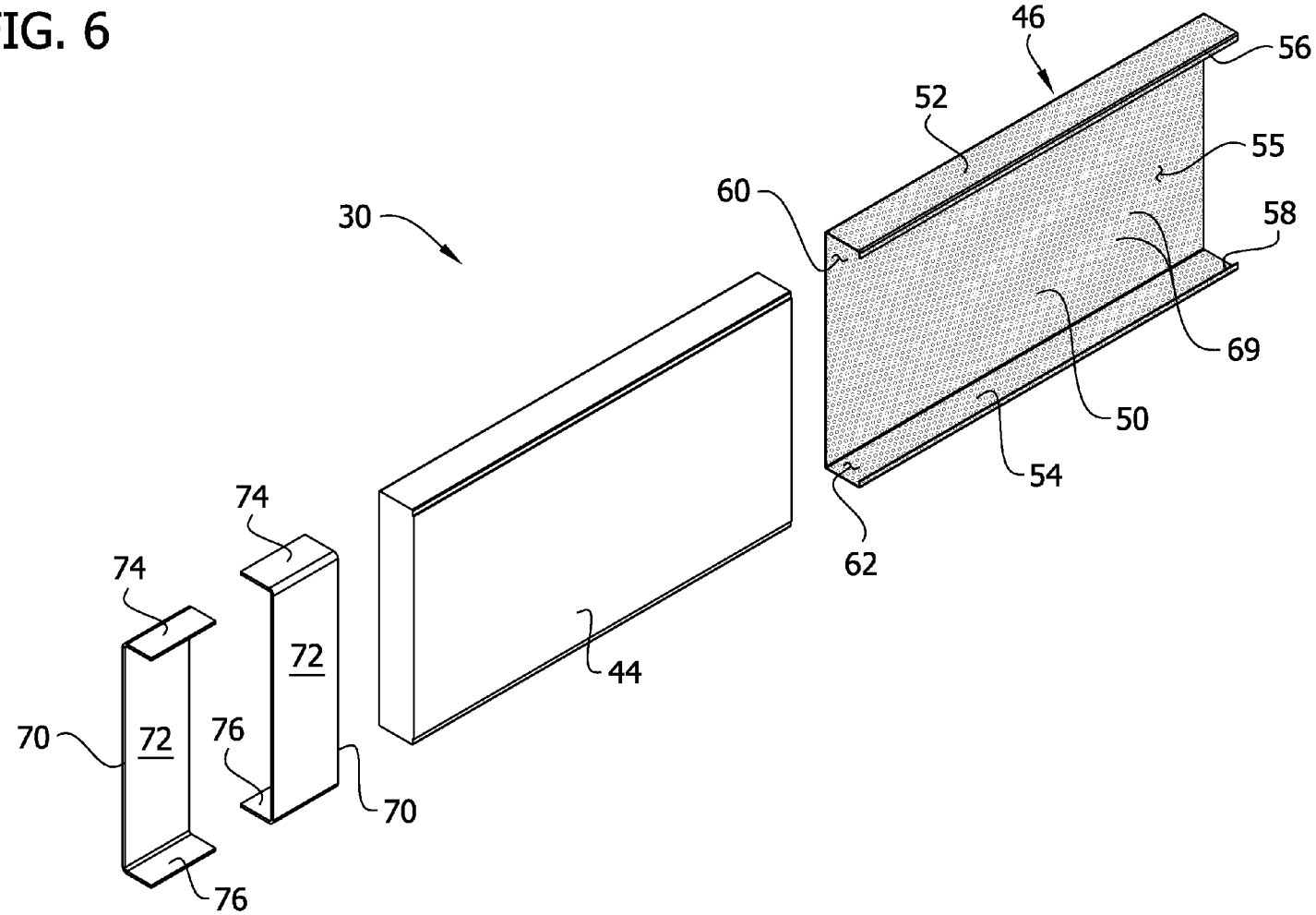
FIG. 6 is an exploded view of the acoustic module of FIG. 5.

Referring to FIG. 5, the acoustic module 30 may have a vertical height H1 (extending between the upper and lower retainer walls 52, 54) from about 6 in (15.24 cm) to about 24 in (60.96 cm), and a horizontal transverse dimension T1 (extending perpendicular to the height) from about 12 in (30.48 cm) to about 96 in (2.44 m). As explained in more detail below, it is envisioned that the acoustic modules 30 will have standard dimensions, including standard height and transverse dimensions, and may be cut to accommodate door panels of various dimensions and configurations. For example, in FIGS. 3 and 4, the illustrated door panel 20 includes a rectangular window 66, such that the second, third and fourth modules 30 from the top have transverse dimensions T1 that are less than transverse dimensions of the uppermost module and the fifth and sixth modules from the top. The acoustic retainer 46 may be constructed from a perforated, unitary sheet of metal, or other material. For example, the retainer may be formed from a perforated 20 gauge sheet of galvanized steel that is bent into the desired configuration. From about 30% to about 50% of the total area of the sheet may be open due to the perforations (i.e., openings 69) in the sheet. Only FIG. 6 shows the perforations 69 for ease of illustration and for purposes of clarity.) The acoustic retainer 46 may be constructed from other material and formed in other ways. The acoustic insulation member 44 may comprise mineral wool, such as 6 pcf mineral wool, or other types acoustic insulation material.

Figure 3:
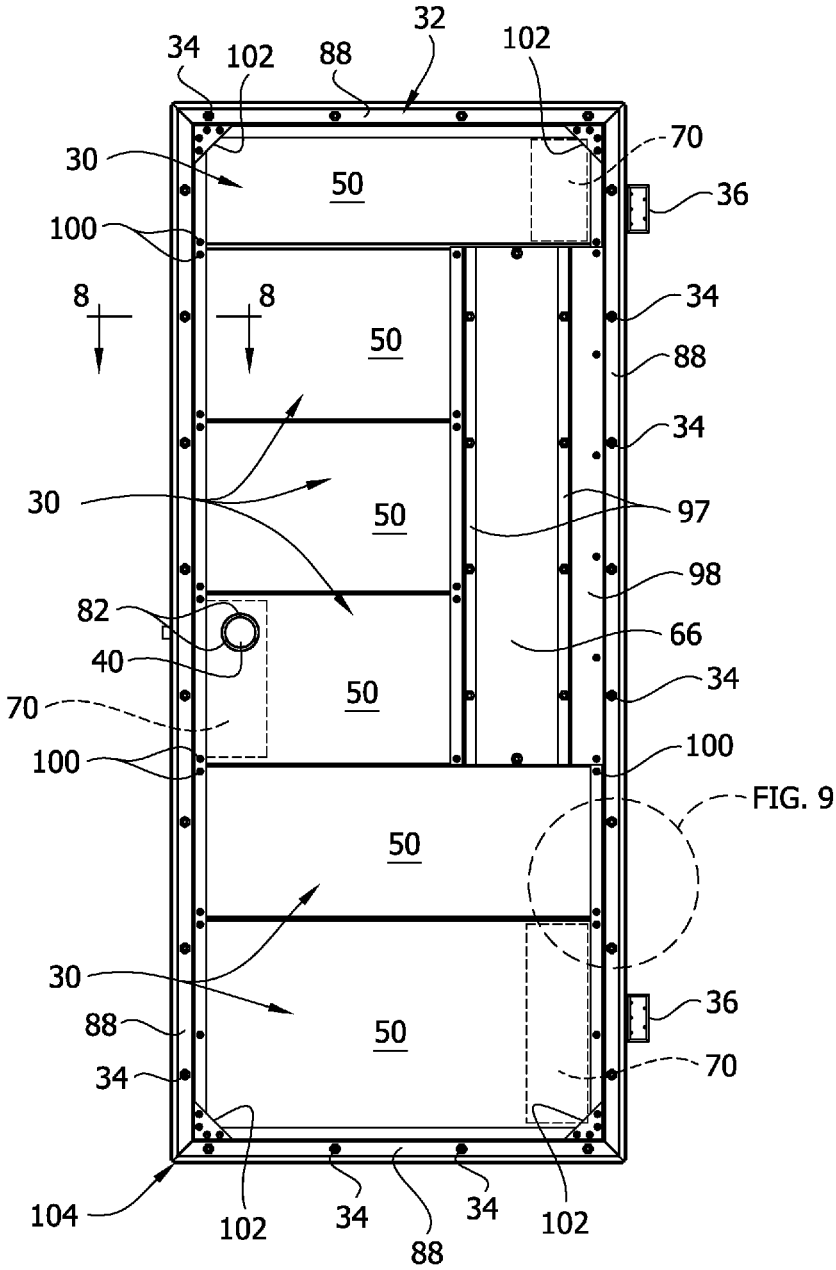
FIG. 3 is a rear elevational view of the door panel.
Figure 7:
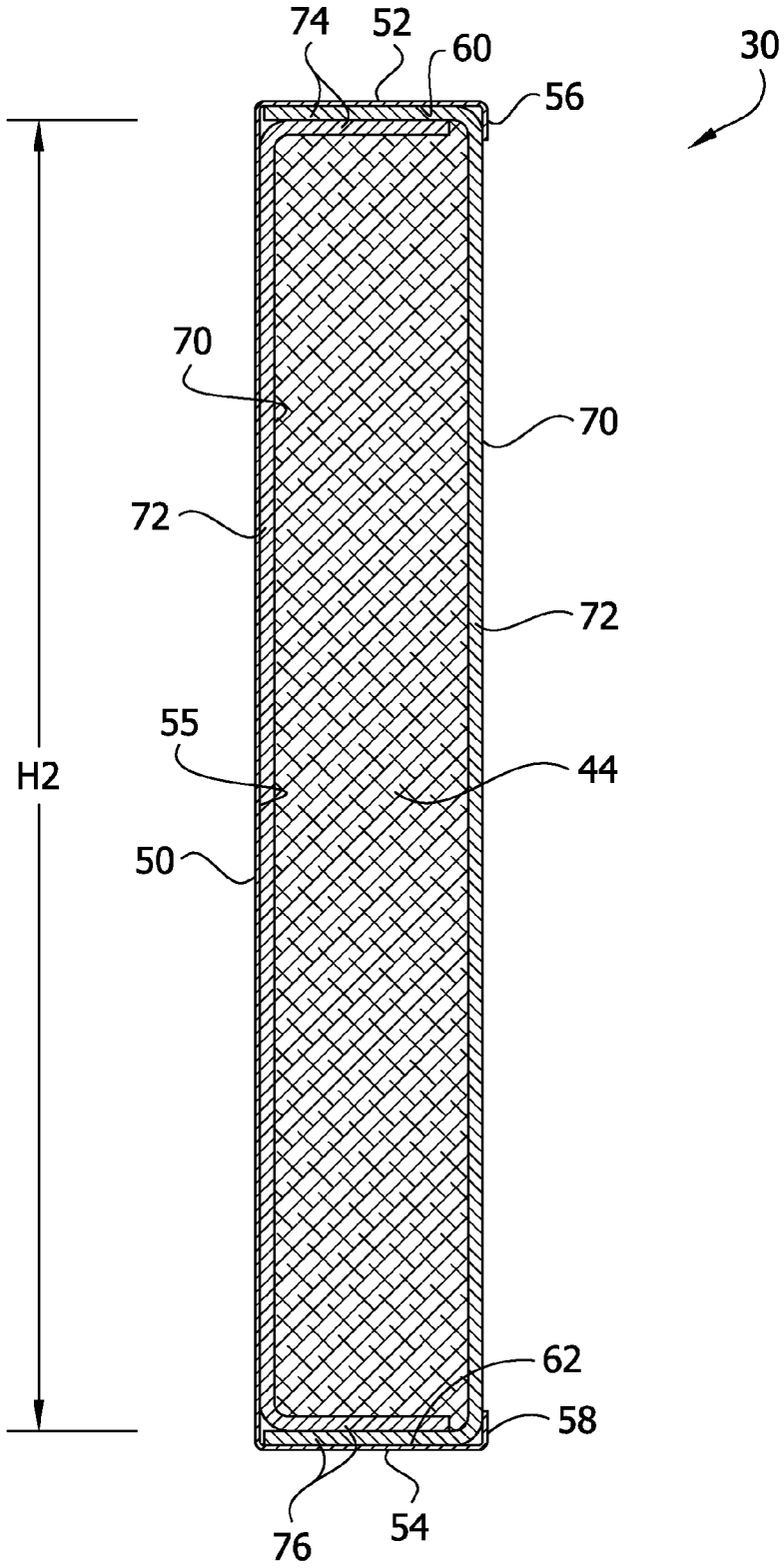
FIG. 7 is a cross section of the acoustic model taken in the plane of line 7-7 in FIG. 5.

Referring to FIGS. 3 and 5-7, the acoustic module 30 may also include one or more attachment plates 70 for use in attaching the door components (e.g., the exterior handle 38, the release handle 40, and the hinges 36, as shown in FIG. 3) to the acoustic module. It is envisioned the attachment plate 70 will be included with only those acoustic modules 30 to which door components, or other panel components, are to be attached. An acoustic module 30 that includes the attachment plate 70 is referred to herein as an "attachment acoustic module." In the illustrated embodiment (FIGS. 6 and 7), the attachment plate 70 is generally C-shaped having an attachment base 72, and upper and lower arms 74, 76, respectively, extending outward from the attachment base. As shown in FIGS. 6 and 7, the attachment plate 70 is sized and shaped for sliding reception (i.e., nesting) in the retainer channel-shaped cavity 55 of the acoustic retainer 46. In particular, the attachment plate 70 is slidably insertable into the channel-shaped cavity 55 through one of the open channel-shaped cavity ends so that the upper and lower arms 74, 76, of the attachment plate slide horizontally within respective upper and lower retainer tracks 60, 62. As such, the attachment plate 70 is slidably positionable at generally any horizontal location along the acoustic module 30 and the door plate 22 for attaching one or more of the door components 36, 38, 40 to the acoustic module at any horizontal (i.e., transverse) location. The attachment plate 70 has a vertical height H2 (FIG. 7) slightly less than the height H1 of the acoustic retainer 46, and a horizontal transverse dimension T2 (FIG. 5), perpendicular to the height, that is less than the horizontal transverse dimension T1 of the retainer. For example, the transverse dimension T2 of the attachment plate 70 may be less than about 50%, or less than about 35%, or less than about 25% of the transverse dimension T1 of the acoustic retainer 46. The attachment plates 70 may be formed from metal, such as stainless steel, or other types of materials.

As a non-limiting example, in the illustrated embodiment shown in FIGS. 3 and 4, each of the two of the attachment acoustic modules 30 (i.e., an upper acoustic module and a lower acoustic module) includes one attachment plate 70 for attaching one of the upper and lower hinges 36 to the corresponding acoustic module. The attachment plates 70 are positioned in respective retainer channel-shaped cavities 55 such that the attachment bases 72 are adjacent to the door plate 22, the arms 74, 76 extend toward the respective retainer bases 50, and the acoustic insulation members 44 are disposed between the respective retainers and attachment plates. The attachment plates 70 are positioned adjacent to the open ends of the retainers 50 of respective modules 30, and fasteners 80 (e.g., self-tapping screws, as shown in FIG. 4) are inserted through the hinges 36 and the door plate 22 and into the attachment bases 72 of the respective attachments plates.

Referring to FIGS. 5-7, the illustrated embodiment also includes an attachment acoustic module 70 having an opposing pair of attachment plates 70 for attaching the exterior handle 38 and the associated release handle 40 to the attachment acoustic module. As shown in FIG. 7, the respective upper and lower arms 74, 76 of the two of attachments plates 70 overlap (i.e., nest) so that, as nested, the respective arms fit within the respective upper and lower tracks 60, 62 of the retainer 46, and the respective attachment bases 72 are disposed opposite sides side of the acoustic insulation member 44 (i.e., the acoustic insulation member is sandwiched between the attachment bases). The attachment plates 70 are positioned at a horizontal location corresponding to the horizontal locations of the exterior handle 38 and release handle 40. Fasteners 80 (e.g., self-tapping screws) are inserted through the exterior handle 38 and into the adjacent attachment base 72 to secure the exterior handle to the attachment acoustic module 30, and fasteners 82 (e.g., self-tapping screws, FIG. 3) are inserted through the release handle 40 and the retainer base 50 and into the adjacent attachment base to secure the release handle to the attachment acoustic module.

Figure 8:
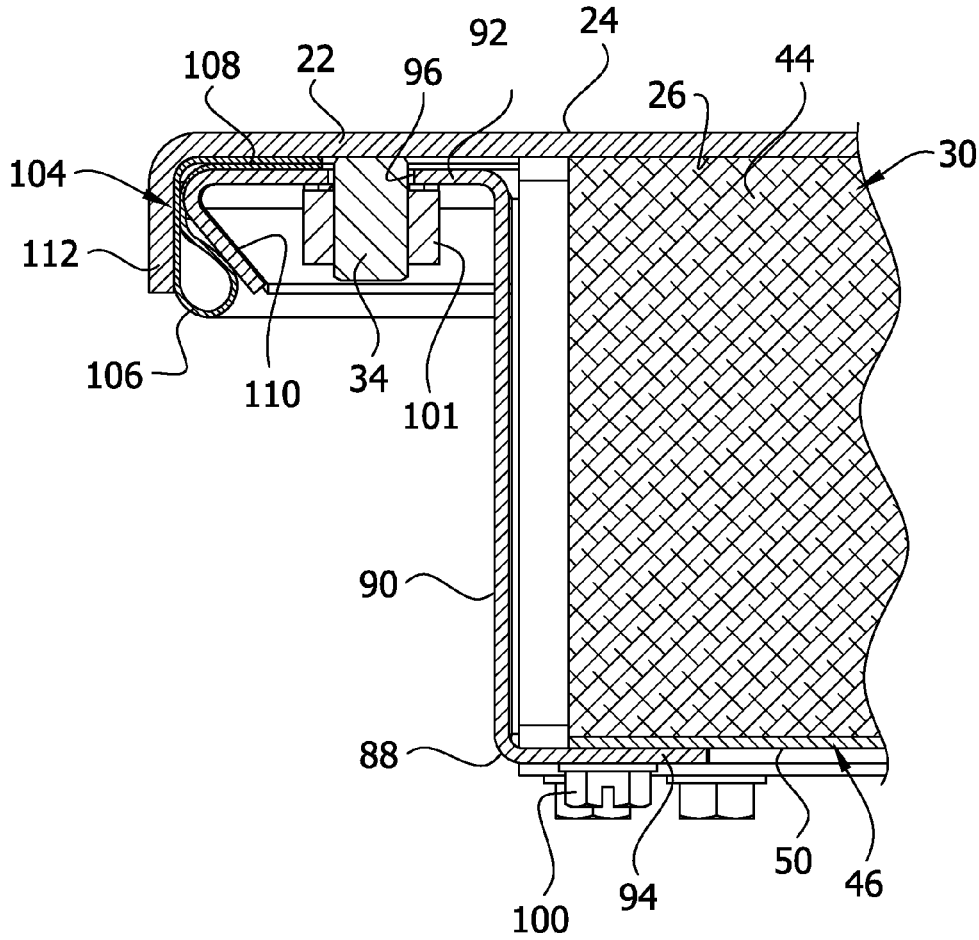
FIG. 8 is a partial sectional view of the door panel taken in the plane of line 8-8 in FIG. 3.

Referring to FIGS. 3, 4, 8 and 9, as described above the acoustic modules 30 are secured to the interior side 26 of the door plate 22 by the module frame 32. In the illustrated embodiment, the module frame 32 includes frame members 88 (i.e., upper, lower, left, and right frame members) secured to the interior side 26 of the door plate 22 and extending around at least a portion of the periphery of the acoustic module assembly (i.e., the stacked modules 30). In the illustrated embodiment, internal window frame members 97 run along either side of the window 66 to secure the second, third, and fourth modules (from the top) to the door panel 20, and to secure an extension plate 98 between the window and the left frame member 88. Referring to FIG. 8, the frame members 88 comprise elongate z-brackets (i.e., brackets that are generally z-shaped in cross section), each having an elongate central portion 90, a door plate-mounting flange 92 extending laterally outward from one side of the central portion, and a retainer-engaging flange 94 extending laterally outward from the opposite side of the central portion in a direction opposite that of the door plate-mounting flange.

Figure 9:
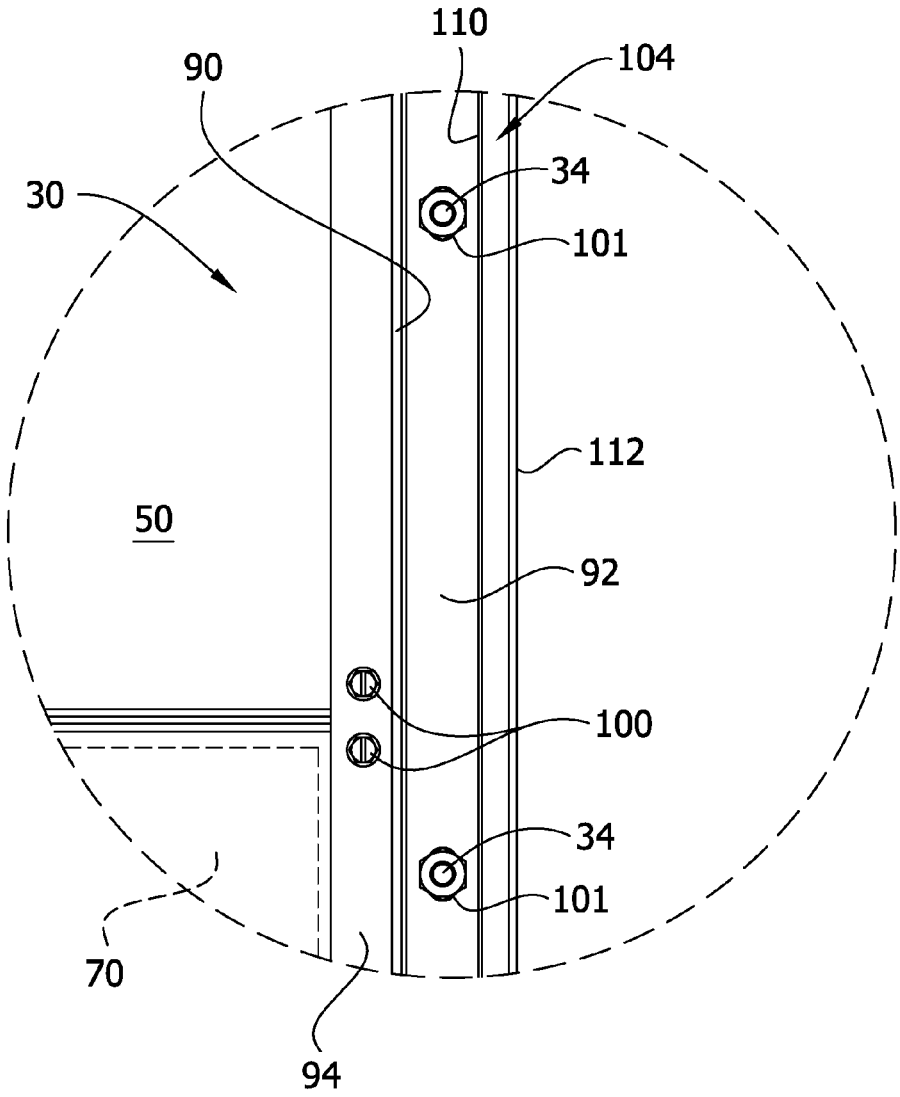
FIG. 9 is an enlarged view of a module frame as indicated in FIG. 3.

Referring to FIGS. 8 and 9, the plate-mounting flange 92 has a plurality of longitudinally spaced apart openings 96 through which the threaded studs 34 on the interior side 26 of the door plate 22 are inserted, and nuts 100 (FIG. 8) thread on the threaded studs to secure the frame members 88 to the door plate 22. The central portion 90 extends alongside the corresponding upper, lower, left and right sides of the module assembly, in opposing relationship therewith, and the retainer-engaging flanges 94 extend over (overlaps) the peripheral edge margin of the module assembly (i.e., the stacked acoustic modules 30) so that a large, central region of the module assembly, which includes the retainer bases 50 of the modules, is uncovered and exposed. In the illustrated embodiment (shown best in FIG. 9), screws 100 (or other fasteners) are threaded through the retainer-engaging flanges 94 and into the retainer bases 50 of the modules 30 to attach the modules to the retainer-engaging flanges. Corner gussets 102 are also secured to adjacent longitudinal ends of the frame members 88 (FIG. 3).

Referring to FIGS. 3, 4 and 8, a peripheral gasket, generally indicated at 104, is sandwiched between the door plate-mounting flanges 92 of the frame members 88 and the interior side 26 of the door plate 22. In the illustrated embodiment, (see FIG. 8), the peripheral gasket 104 comprises one or more bulb gaskets (indicated by the same reference numeral 104) each including a compressive bulb section 106 and an attachment flange 108 extending laterally outward from the bulb section. The attachment section 108 is sandwiched between the plate-mounting flanges 92 of the frame members 88 and the interior side 26 of the door plate 22, and the threaded studs 34 pass through the attachment section. The gasket 104, particularly the attachment section 108, absorbs vibrations between the module frame 32 and the door plate 22 to reduce noise that may propagate through the door panel 20. The bulb section 106 is trapped between peripheral lips 110 (e.g., return flanges) on the plate-mounting flanges 92 and a peripheral flange 112 on the interior side 26 of the door plate 22. The bulb section 106 is positioned on the interior side 26 of the door plate 22 so that the bulb section is compressed between the door plate and a door frame (e.g., a door jam) when the door panel 20 is closed to create an effective seal upon closing the door. The peripheral lips 110 of the frame members 88 are slanted to function as stops for the bulb section 106 to allow the bulb section to compress to the proper level when the door panel 20 is closed. In the embodiment where the panel is a wall panel (FIG. 10), the bulb section 106 is likewise compressed between a panel plate (similar to the door plate) and a frame of the enclosure.

In one non-limiting method of making the illustrated door panel 20, the acoustic modules 30 can pre-assembled according to standard dimensions so that all of the modules have substantially the same size and shape. The acoustic retainer 46 may be formed by bending a sheet of metal, as set forth above, and the acoustic insulation 44 member may be inserted (i.e., packed) into the formed retainer channel-shaped cavity 55. Using the pre-assembled modules 30, one or more of the attachment plates 70 may be slidably inserted into the retainer channel-shaped cavity 55, as set forth above, to horizontal positions depending on the predetermined dimensions and configurations of the particular door panel 20, including the locations of any door components (e.g., the exterior door handle 38, the release handle 40, the hinges 36, and the window 66). The pre-assembled modules 30 may also be cut according to the planned dimensions of the door panel 20 before assembling the door panel. For example, the transverse dimensions T1 of the acoustic modules 30 may be shortened and/or openings may be cut in the acoustic modules for window(s) or vent(s).

The door panel 20 is assembled by sandwiching the gasket 104 between the upper and lower frame members 88 and the interior side 26 of the door plate, and between one of the left and right frame members 88 and the interior side of the door plate. The threaded studs 34, which were previously welded to the interior side 26 of the door plate 22, are inserted through the openings 96 in the plate-mounting flange 92 of the respective frame members 88, and the nuts 101 are threaded on the studs. With three of the frame members 88 secured to the door plate 22, the acoustic modules 30 are stacked in the partial frame 32 by sliding the lowermost acoustic module into engagement with the lower frame member 88 and the secured left or right frame member. The other acoustic modules 30 are then sequentially stacked one on top of the other. The internal frame members, such as internal frame members 97 for windows and other openings, may be secured to the door plate 22 after stacking respective modules that are secured by the internal frame members. With all of the acoustic modules 30 properly stacked, the remaining unsecured left or right frame member 88 is secured to the door plate 22 using the respective threaded studs 34 and the nuts 101. After the acoustic module assembly is secured to the interior side 26 of the door plate 22, the respective door components (the exterior door handle 38, the release handle 40, the hinges 36) can be attached to the door panel 20. For example, the exterior door handle 38, the release handle 40, the hinges 36 can be secured to the respective acoustic modules 30 by threading the fasteners 80 into the respective attachment plates 70.

As can be seen from the above description, the use of acoustic modules 30 simplifies the process of constructing, customizing, modifying, and installing enclosure door panels (and wall panels). In particular, the acoustic modules can be constructed independent of knowing the exact dimensions needed to replace an enclosure door panel 20, and at the job site, the acoustic modules 30 can be individually cut to desired sizes. Also, modifications, such as cuts made to accommodate openings, vents, and windows, can be readily made at the job site. Moreover, the acoustic modules 30 can be individually replaced, without having to replace all of the acoustic modules.

In addition to simplifying the constructing process, the fact that the acoustic modules 30 are not directly secured to one another and are "floating" between the door plate 22 and module frame 32 means that the door panel 20 is less likely to permanently distort due to thermal discrepancies between the interior and exterior of the enclosure 10. In this regard, the interior of the enclosure 10 typically is significantly hotter than outside the enclosure, especially when the enclosure is housing a gas turbine engine. Accordingly, the retainers 46 and the module frame 32, which are usually constructed from metal, absorb heat and tend to expand. The door plate 22, on the other hand, is exposed to lower exterior temperatures, and may tend to expand (or even contract) at a rate different from the retainer 50 and/or the module frame 32. Because the acoustic modules 30 are held movably captive by the module frame 32, rather than welded to the door plate 22, and because the module frame is bolted to the door plate, rather than welded thereto, the entire acoustic module assembly is capable of expanding relative to the door plate without distorting the door panel 20. Moreover, individual acoustic modules 30 may expand and contract independently of other acoustic modules without distorting one another.

Figure 10:
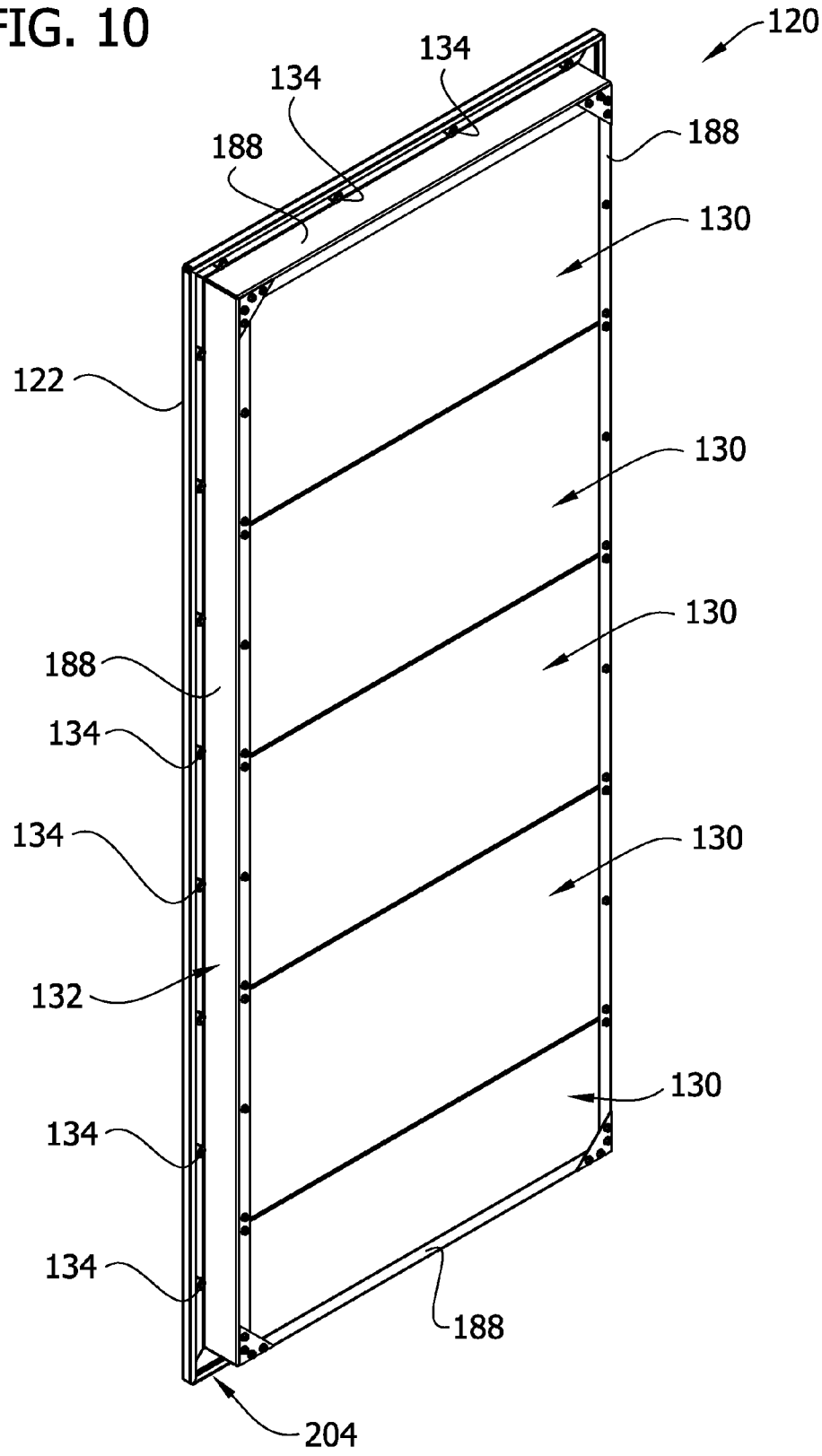
FIG. 10 is rear perspective of a wall panel for the enclosure in FIG. 1.

Referring to FIG. 10, an embodiment of a wall panel for the enclosure 10 is generally indicated at 120. The wall panel 120 is substantially similar to the door panel 20, except that the wall panel does not include door components such as hinges and handles. Other than this difference, however, the wall panel 120 may have the same configuration and may be constructed in the same fashion as the door panel. In other words, as shown in FIG. 10, the wall panel 120 includes a wall plate 122 (broadly, a panel plate) having opposite interior and exterior sides, an acoustic module assembly including a plurality of the acoustic modules 130 (the same type of acoustic modules as used in the door panel) secured on the interior side of the wall plate by a module frame 132 including z-brackets 188, and a gasket 204 (e.g., a bulb gasket) between the module frame and the interior side of the wall plate. The frame 132 is secured to threaded studs 134 welded on the wall plate 122. The wall panel 120 with the acoustic modules 130 has the same advantages as the door panel, set forth above.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An acoustic panel for an enclosure comprising:

a panel plate having opposite interior and exterior sides;

an acoustic module assembly including a plurality of acoustic modules secured on the interior side of the panel plate, wherein each acoustic module includes a retainer having a retainer base, spaced in generally opposing relationship with the panel plate, and upper and lower retainer walls extending outward from the retainer base toward the panel plate to define a horizontal channel-shaped cavity, and an acoustic insulation member received in the horizontal channel-shaped cavity of the retainer, such that the acoustic insulation member is positioned between the interior side of the panel plate and the retainer base.

2. The acoustic panel set forth in claim 1, wherein at least one of the plurality of acoustic modules is an attachment acoustic module that further includes an attachment plate nested in the horizontal channel-shaped cavity of the corresponding retainer, the acoustic panel further comprising a door component on the exterior side of the panel plate fastened to the attachment plate via at least one fastener.

3. The acoustic panel set forth in claim 2, wherein the attachment plate is slidably received in the horizontal channel-shaped cavity of the corresponding retainer for movement along the horizontal channel-shaped cavity.

4. The acoustic panel set forth in claim 3, wherein the retainer of the attachment acoustic module includes an upper lip on the upper wall extending toward the lower wall to define an upper horizontal track extending along the channel-shaped cavity, and a lower lip on the lower wall extending toward the upper wall to define a lower horizontal track extending along the channel-shaped cavity, and wherein the attachment plate is slidably received in the upper and lower horizontal tracks.

5. The acoustic panel set forth in claim 4, wherein the attachment plate is generally C-shaped and base an attachment base and upper and lower arms extending outward from the attachment base, wherein the upper and lower arms are slidably received in respective upper and lower horizontal tracks, and wherein the at least one door component fastener is fastened to the attachment base.

6. The acoustic panel set forth in claim 1, wherein the acoustic modules are stacked along a height of the panel plate.

7. The acoustic panel set forth in claim 6, wherein the acoustic module assembly has a periphery disposed within a periphery of the panel plate, the acoustic panel further comprising a module frame secured on the interior side of the panel plate, the module frame having a periphery within the periphery of the panel plate and extending around the acoustic module assembly to retain the acoustic modules on the interior side of the panel plate.

8. The acoustic panel set forth in claim 7, wherein the module frame has a plurality of openings spaced apart along the module frame, and a plurality of threaded studs welded to the interior side of the panel plate and extending through the openings in the module frame to secure the module frame to the panel plate.

9. The acoustic panel set forth in claim 8, wherein the module frame includes a plurality of elongate z-brackets.

10. The acoustic panel set forth in claim 7, further comprising a bulb gasket including a bulb section and an attachment section extending laterally outward from the bulb section, wherein the attachment section is sandwiched between the interior side of the door plate and the module frame, and the bulb section extends around the periphery of the module frame and within the periphery of the panel plate.

11. The acoustic panel set forth in claim 10, wherein the panel plate has a peripheral flange extending outward from the interior side, and the module frame has a peripheral lip extending away from the interior side and spaced from the peripheral flange, wherein the bulb section of the bulb gasket is disposed between the peripheral flange and the peripheral lip.

12. An acoustic module for a panel of an enclosure, the acoustic module comprising:

a retainer having a perforated retainer base, upper and lower retainer walls extending outward from the retainer base to define a horizontal channel-shaped cavity, and upper and lower lips extending toward one another from respective upper and lower retainer walls to define respective upper and lower tracks extending along the horizontal channel-shaped cavity; and an acoustic insulation member received in the horizontal channel-shaped cavity of the retainer, wherein the acoustic insulation member has upper and lower edge margins received in respective upper and lower tracks of the retainer to facilitate retention of the acoustic insulation member in the horizontal channel-shaped cavity.

13. The acoustic module set forth in claim 12, further comprising an attachment plate nested in the upper and lower tracks of the retainer, wherein the attachment plate is configured for use in attaching a door component to the acoustic module.

14. The acoustic module set forth in claim 13, wherein the attachment plate is slidably received in the upper and lower tracks of the corresponding retainer for movement along the horizontal channel-shaped cavity.

15. The acoustic module set forth in claim 14, wherein the attachment plate is generally C-shaped and has an attachment base and upper and lower arms extending outward from the attachment base, wherein the upper and lower arms are slidably received in the respective upper and lower horizontal tracks, and the attachment base is in generally opposing relationship with the retainer base.

16. The acoustic module set forth in claim 15, wherein each of the retainer and the attachment plate has a height and a transverse dimension, the transverse dimension of the attachment plate being less than the transverse dimension of the retainer.

17. The acoustic module set forth in claim 16, wherein the transverse dimension of the attachment plate is less than about 50% of the transverse dimension of the retainer.

18. A method of making an acoustic panel for an enclosure comprising:

stacking a plurality of acoustic modules on an interior side of a panel plate, each acoustic module including a retainer having a retainer base and upper and lower retainer walls extending outward from the retainer base to define a horizontal channel-shaped cavity, and an acoustic insulation member received in the horizontal channel-shaped cavity of the retainer; and attaching a module frame to the interior side of the panel plate to secure the stacked plurality of acoustic modules on the interior side of the panel plate.

19. The method set forth in claim 18, wherein said attaching a module frame includes attaching the module frame to threaded studs extending outward from the interior side of the panel plate.

20. The method set forth in claim 19, wherein said attaching a module frame includes attaching at least one frame member of the frame to the interior side of the panel plate before said stacking the acoustic modules, and attaching another second frame member of the frame to the interior side of the panel plate after said stacking the acoustic modules.

* * * * *